United States Patent [19]

Velling et al.

[11] 4,305,705

[45] Dec. 15, 1981

[54] APPARATUS FOR IGNITING A GAS MIXTURE

[76] Inventors: Günther Velling, Rheinstrasse 236, 5303 Bornheim-Hersel; Wolfhard Ruddeck, Eggenbruch 55, 5600 Wuppertal 1, both of Fed. Rep. of Germany

[21] Appl. No.: 55,735

[22] Filed: Jul. 9, 1979

[30] Foreign Application Priority Data

Jul. 21, 1978 [DE] Fed. Rep. of Germany ..... 2832115

[51] Int. Cl.[3] ..... F23D 11/44

[52] U.S. Cl. ..... 431/208; 431/6; 431/216; 219/300

[58] Field of Search ..... 431/208, 11, 3, 29, 431/216, 6; 219/300

[56] References Cited

U.S. PATENT DOCUMENTS

| | | | |
|---|---|---|---|
| 1,981,299 | 11/1934 | Beckler | 431/208 |
| 2,318,195 | 5/1943 | Cate | 431/74 |
| 2,411,040 | 11/1946 | Holthouse, Jr. | 431/208 |
| 2,938,577 | 5/1960 | Hughey | 431/29 |
| 3,485,565 | 12/1969 | Kaartinen | 431/3 |

FOREIGN PATENT DOCUMENTS

| | | | |
|---|---|---|---|
| 2306840 | 8/1974 | Fed. Rep. of Germany | 431/208 |

*Primary Examiner*—Samuel Scott
*Assistant Examiner*—Lee E. Barrett
*Attorney, Agent, or Firm*—Seidel, Gonda, Goldhammer & Panitch

[57] ABSTRACT

Apparatus for igniting a main gas mixture to be burnt in a combustion chamber includes conduit systems for separately feeding an oxygen-bearing gas and a combustible gas into an ignition region. At least a part of at least one of the conduit systems is formed as an electrical heating resistance thereby to raise the temperature of the gas component flowing therein so that when the components are mixed in the ignition region, ignition of the ignition gas mixture will occur, thereby igniting the main gas mixture. The apparatus also includes means for detecting the temperature of the heated gas component or components flowing through the conduit systems, and/or the temperature of the gas mixture ignited in the ignition region.

24 Claims, 1 Drawing Figure

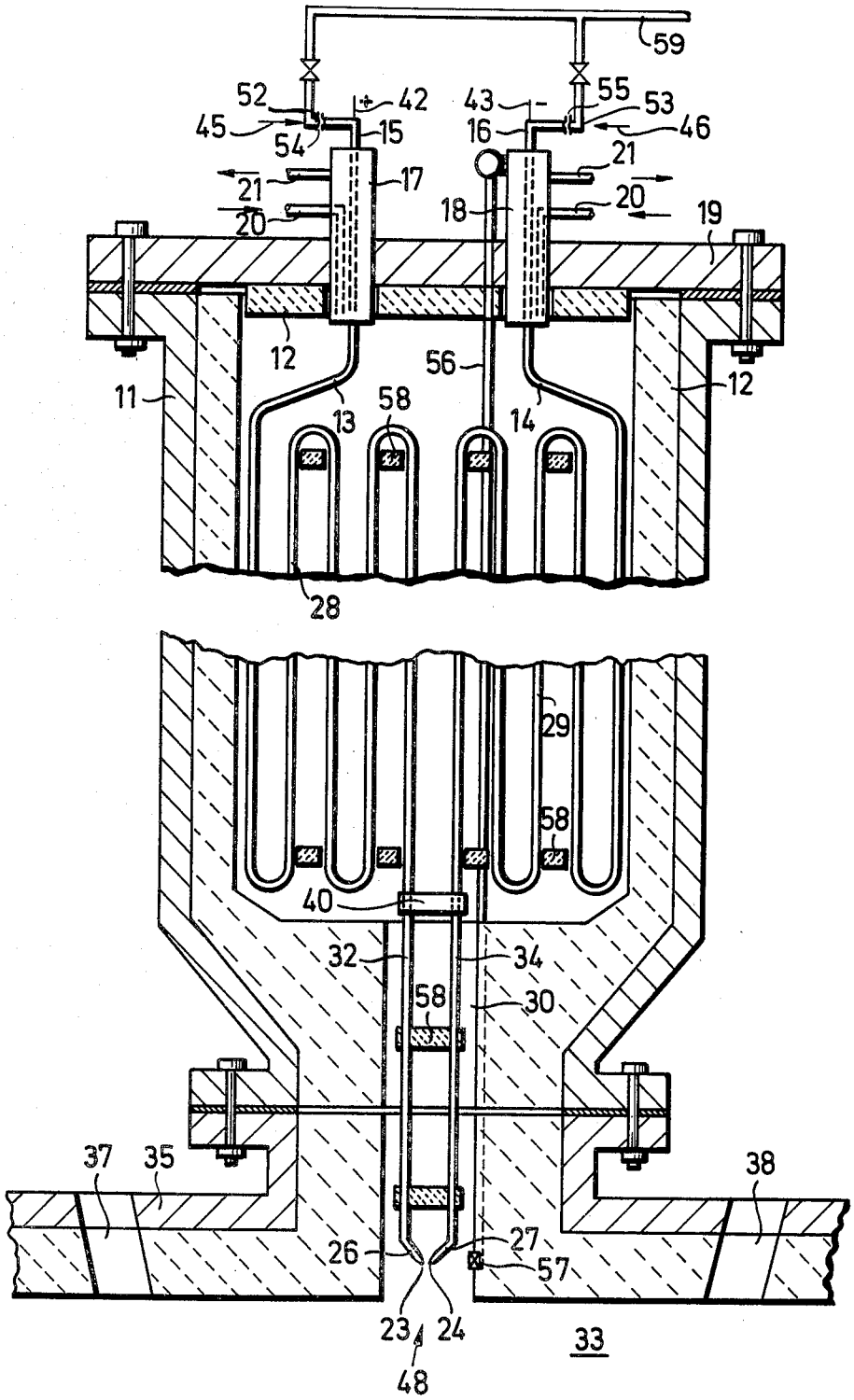
59
52
42
43
55
53
45
54
15
16
46
21
17
21
20
18
20
19
12
56
12
11
13
58
14
28
29
58
40
32
34
58
30
37
35
38
26
27
57
23
24
48
33

APPARATUS FOR IGNITING A GAS MIXTURE

BACKGROUND OF THE INVENTION

It has been found that, under certain conditions, it may be difficult to ignite a combustible gas mixture, for example a gas mixture comprising hydrogen and air. This is particularly the case when the combustible gas mixtures are under high pressure.

An example which may be mentioned in this connection is the hydrogenating gasification of solid carbon. It is necessary for the hydrogen which is used as the gasification agent to be raised to a temperature which is suitable for gasification, and which may be 900° C. for example depending on the nature of the coal to be gasified. Conventional heating means, for example heat exchangers, are not normally sufficient to achieve such a temperature. Consequently, a part of the hydrogen must be burnt in order to reach the required temperature level.

Previously proposed methods of igniting such a gas mixture have been found to be unsatisfactory from the point of view of reliability, in particular in regard to safety requirements. If for example hydrogen, methane, heating or fuel gas or the like are mixed, individually or in mixture with each other, with an oxygen-bearing gas such as air, in most practical cases it is necessary to ensure that the reaction between the constituents of the mixture and therefore combustion occurs at the location of the mixing operation, under controllable conditions, as otherwise there is the danger that the combustible mixture may undergo combustion in a manner which is uncontrolled in respect of time and/or location and/or amount and/or speed, as by exploding.

SUMMARY OF THE INVENTION

An object of the invention is to provide a process and apparatus which avoids the shortcomings of the previously known arrangements.

A further object of the invention is to provide an ignition process and apparatus which can cause ignition of a main gas mixture in a simple, reliable and controllable manner.

Yet another object of the invention is to provide an ignition apparatus which will operate satisfactorily over a prolonged period of operation, under all conditions which occur in practical use.

A still further object of the invention is to provide a gas mixture ignition apparatus which is capable of operating under high gas pressures.

A yet further object of the invention is to provide an ignition apparatus whose operation can be detected and monitored at any time, while being of simple construction with a high level of operating reliability.

Another object of the invention is to provide a gas mixture ignition apparatus which does not involve any moving parts for ignition of the mixture, and which may be left in operation continuously to ensure that the main gas mixture is always immediately ignited.

These and other objects are achieved by an apparatus comprising at least first and second conduit systems for separately feeding an oxygen-bearing gas and a combustible gas to an ignition region in which the two components to form an ignition gas mixture are mixed. At least a part of at least one of the conduit systems provides electrical resistance heating action in order to raise the temperature of at least one of the gas components of the ignition gas mixture to a temperature at which ignition of the mixture will occur upon mixing thereof. The apparatus further comprises means for detecting the temperature of the heated component or components flowing in the conduit system or systems, and/or for detecting the temperature of the ignited ignition gas mixture.

The components of the ignition mixture are heated, in the electrically heated conduit systems, until the gas mixture which forms at the outlet from the conduit systems is at a temperature which is not less than the ignition temperature of the mixture. This can be readily controlled by suitable adjustment of the electrical heating output. Because the oxygen-bearing component, for example air, and the combustible gas, for example hydrogen or methane, are fed separately from each other to the region in which ignition is to occur, this ensures that ignition occurs only after the gases have issued from the conduit systems which carry them. Thus, at the outlets from the conduit systems there is formed an ignition flame which can be readily adjusted, in respect of size, temperature and durability, so that immediate and controlled ignition of the main gas mixture is guaranteed, when the main gas mixture comes into contact with the ignition frame. It has been found in practice that the ignition apparatus operates satisfactorily even when the main gas mixture to be ignited is under a pressure of 120 bars or more.

The presence of the ignition flame may be detected or monitored, in a simple manner, by disposing a temperature sensing means in or adjacent to the region in which ignition of the ignition gas mixture occurs. This means that the temperature sensor is in the vicinity of the outlets of all the conduit systems from which the components forming the ignition gas mixture issue. It is also possible however for a termperature sensor to be so arranged as to detect the temperature in one or more of the conduit systems, possibly in addition to the sensor in or adjacent to the ignition region, in order to draw therefrom conclusions regarding the respective prevailing conditions of operation.

The apparatus may also include means whereby at least one of the conduit systems may be alternatively connected to a supply conduit for inert gas, for example nitrogen or carbon dioxide. This arrangement makes it possible, when starting up the ignition apparatus, for example for an inert gas to be passed through the conduit system, instead of the oxygen-bearing gas, and this supply of inert gas is continued until the ignition temperature of the ignition gas mixture has been reached. The conduit system is then switched over so as to be connected to the supply conduit for the oxygen-bearing gas, whereupon the mixture is ignited as soon as the oxygen-bearing gas which is now being fed into the ignition region has reached the temperature required for ignition of the mixture. The operation of switching over from inert gas to the other gas may be caused by a signal or by a control command which is triggered by a temperature sensing means. The purpose of using an inert gas during the starting-up phase is to prevent the formation of a combustible gas mixture, before the ignition temperature is reached, so that no ignitable gas mixture is formed until it is certain that ignition will occur. Normally, the main gas mixture which is to be ignited by the ignition mixture is not introduced into the combustion chamber unless the means for detecting the temperature of the ignition gas mixture indicate that an ignition flame is present. In this case also, the temperature sensing means or the like may trigger a control command which causes the main gas mixture, or the components which form the main gas mixture, to flow into the combustion chamber.

It will generally be desirable for the ignition gas mixture to be composed of the same components as the main gas mixture which is to be burnt in the combustion chamber, although this is not necessarily the case. Thus, in the case of combustion of a hydrogen-air mixture, as mentioned above, it is readily possible to use air and methane, or other oxygen-bearing gases and/or combustible gases, to form the ignition gas mixture.

It will often be advantageous for the conduit systems for all the components of the ignition gas mixture to be formed as electrical heating resistances, and all the conduit systems may form a common electrical heating resistance system. This means that the conduit systems are electrically connected in series. However, it is also possible for each conduit system to form a separate electrical heating resistance system.

The conduit systems are advantageously arranged in a housing which is mounted on the wall of the combustion chamber or the like, in which the main gas mixture is to be burnt.

BRIEF DESCRIPTION OF THE DRAWING

The drawing shows an embodiment of the apparatus in longitudinal section.

DESCRIPTION OF THE PREFERRED EMBODIMENT

Referring to the drawing, an ignition apparatus comprises a housing 11 which is thermally insulating by means of a lining or inner cladding 12 such as a ceramic cladding or a cladding formed in some other suitable manner. Disposed in the housing 11 are first and second conduit systems 13 and 14. One end 15 and 16 respectively of each conduit system 13 and 14 is extended out of the housing 11, by way of an interposed, thermally insulating member 17 and 18 respectively, fitted into an end wall 19 of the housing 11. The members 17 and 18 have cooling water flowing through them, the cooling water being supplied to and taken from the members 17 and 18 by respective conduits 20 and 21.

The other ends 23 and 24 of the conduit systems 13 and 14 which form outlets for the components of the ignition gas mixture, are arranged at a small spacing from each other, at the end of the housing 11 which is remote from the end wall 19, in such a way that the gases which issue from the ends 23 and 24 of the conduit systems, under pressure, mix with each other. In order to improve the mixing action, end portions 26 and 27 of the conduit systems 13 and 14 are angled in such a way that they are directed towards each other, as clearly visible in the drawing. The outlets of the conduit systems are thus disposed adjacent a combustion chamber 33 in which a main gas mixture is to be burnt, after ignition by the ignition gas mixture; the apparatus is fixed to the wall 35 of the chamber 33.

The main body portion of the housing 11, starting from the end wall 19 and extending towards the combustion chamber 33, is of large cross-sectional area, desirably of substantially cylindrical cross-section, and receives tube coils or loops 28 and 29 which form part of the conduit systems 13 and 14 respectively. The main body portion of the housing at the end remote from the end wall 19, goes into a portion defining an interior space of substantially smaller cross-sectional area, as indicated at 30, thus forming a passage leading into chamber 33. Each conduit system 13 and 14 has a straight tube portion 32 and 34 respectively which extend through the portion 30 towards the chamber 33 and which terminate at the outlet ends 23 and 24. The end portions 26 and 27 are disposed in or adjacent to the part of the portion 30 of the housing 11, where it opens into the combustion chamber 33, with the housing 11 being mounted on the wall 35 of the combustion chamber 33, as indicated above. The components for forming the main gas mixture which is to be burnt in the combustion chamber 33 are supplied thereto by way of conduits 37 and 38.

In the embodiment illustrated in the drawing, outside of the housing 11, the conduit system 13 is connected to the positive electrode at 42 of a voltage source, while the conduit system 14 is connected to the negative electrode at 43 of the voltage source. The circuit is closed by a connecting member 40 which bridges over the portions 32 and 34 of the conduit systems 13 and 14. As a result, the conduit systems 13 and 14 therefore provide, eg are formed as, an electrical heating resistance means, between the two connection terminals 42 and 43 on the one hand and the connecting member 40 on the other hand. The conduit systems 13 and 14 which are independent of each other with regard to the gaseous components to be carried therein are electrically connected in series to form an electrical heating resistance. The conduit systems 13 and 14 can thus be heated in a simple manner, and in a precisely controllable fashion, so that gaseous media which flow through the two conduit systems, on issuing at the angled end portions 26 and 27 thereof, are at a given temperature which can be readily adjusted in such a way that the resulting gas mixture is at least at the temperature required for ignition thereof. If for example an oxygen-bearing gas, for example air, is passed through the conduit system 13, as indicated by arrow 45, and hydrogen is passed through the conduit system 14, as indicated by arrow 46, the result, in an ignition region 48 adjacent the outlet ends 23 and 24, is a gas mixture which readily ignites if, for example when using air as the oxygen-bearing gas, its temperature is above 510° C. When using other combustible gases, the ignition temperatures will be suitably selected, for example 650° C. when using methane. When using pure oxygen or air enriched with oxygen, the ignition temperature may be lower in many cases.

An electrical disconnection or insulation point 54 and 55 is inserted into the connection between the conduit systems 13 and 14 and gas supply conduits 52 and 53 which are connected upstream of the respective conduit systems 13 and 14, as viewed in the direction of flow indicated by respective arrows 45 and 46, in order to isolate the conduits 52 and 53 from the electric current in the conduit systems.

The ignition apparatus shown in the drawing is also provided with a temperature sensing means 56 comprising a temperature-responsive element 57 which is arranged in the direct vicinity of the angled ends 26 and 27 of the conduit systems 13 and 14 so that ignition of the gas mixture is immediately detected and signalled by the resulting rise in temperature. The temperature sensing means may be used to give given control signals, in dependence on the respective prevailing operating condition, for example with respect to the feed of an inert gas into one or both of the conduit systems 13 and 14, and switching the feed over to another gas such as for example an oxygen-bearing or combustible gas, as soon as the temperature required for ignition can be reached, by virtue of the heating action of the conduit systems 13 and 14.

In a modified form of the illustrated embodiment, it is possible for only one of the conduit systems to be heated, or for the conduit systems to be heated independently of each other. The latter arrangement would possibly have the advantage that different temperatures could be readily set in the conduit systems. It will be appreciated that the gas temperatures attained in the conduit systems can also be made to differ from each other by the heated tube conduit systems 13 and 14 being of different lengths. In this connection, account should be taken of the fact that the gaseous media flowing through the conduit systems 13 and 14 are not normally the same, with regard to the flow quantity per unit of time. This can be seen for example from the following example which is concerned with raising an ignitable air-hydrogen mixture to ignition temperature:

| Air | | $H_2$ | |
|---|---|---|---|
| Amount | 50 $Nm^3/h$ | Amount | 30 $Nm^3/h$ |
| Pressure | 125 bars | Pressure | 125 bars |
| Inlet | 20° C. | Inlet | 20° C. |
| Outlet | 750° C. | Outlet | 750° C. |
| Tube length | 9.2m | Tube length | 5m |

Electrical heating output 30 kW

It will be understood that the housing 11 will be so constructed and disposed that it is capable of carrying the respective operating pressures obtaining.

Reference numeral 58 denotes holding means for mounting the conduit systems 13 and 14.

In a further development of the apparatus, the apparatus includes means whereby at least one of the conduit systems 13 and 14 can be alternatively connected to a supply conduit 59 for supplying an inert gas such as nitrogen or carbon dioxide. Thus, when starting up the ignition apparatus, an inert gas may be passed through the respective conduit system, instead of the oxygen-bearing gas, and the feed of inert gas is continued until the ignition temperature of the ignition gas mixture has been attained. The supply of inert gas is then stopped by switching over the conduit system which was carrying the inert gas flow, and the oxygen-bearing gas is then passed through that conduit system, so that the mixture is ignited as soon as the oxygen-bearing gas also reaches the temperature required for ignition of the ignition gas mixture. Using the inert gas during the initial phase will prevent the formation of a combustible gas mixture until the ignition temperature is reached, so that no ignitable gas mixture will be formed until it is certain that ignition of the ignition gas mixture will occur. The switching over of the conduit system from inert gas to oxygen-bearing gas may be triggered by a signal or by a control command produced by a temperature sensing means. The or each conduit system may be connected to respective other gas supply conduits, in dependence on the temperature of the electrical heating resistance means. The apparatus may also include more than two conduit systems, if desired.

The above-described process and apparatus will thus produce ignition of a gas mixture in a simple and reliable manner, under controllable conditions. The apparatus will operate satisfactorily over a long period, under any conditions arising in normal practical operation, as under high pressure. Operation of the apparatus can be detected and monitored at any time without difficulty. Furthermore the apparatus does not involve movable parts, which enhances its reliability. Generally, it will be desirable for the apparatus to be left in operation continuously, that is to say, even after ignition of the main gas mixture in the combustion chamber 33. This ensures, under all circumstances which occur in operation, that a gas mixture flowing into the combustion chamber 33 is always immediately ignited and is thus burnt therein.

Various other modifications may be made without thereby departing from the scope of the invention.

What is claimed is:

1. Apparatus for igniting a main gas mixture comprising:

a first conduit system for feeding an oxygen-bearing gas component of a combustible ignition gas mixture to an ignition region;

a second conduit system for feeding a combustible gas component of the ignition gas mixture to the ignition region, separately from the oxygen-bearing gas component, at least part of at least one of the conduit systems providing an electrical heating resistance means for heating the component flowing therein to a temperature adapted to cause ignition of the ignition gas mixture upon mixing thereof in the ignition region;

means for detecting the temperature of at least one of the heated components, said means disposed within at least one of said conduits;

means for alternatively connecting at least one of said conduit systems to a supply means for supplying inert gas; and means for switching over of said at least one conduit system in response to the temperature detecting means, from the inert gas supply means to the gas mixture component supply conduit when a temperature is reached at which ignition of the ignition gas mixture can occur.

2. Apparatus as set forth in claim 1 wherein said temperature detecting means triggers a signal for said switching over of said at least one conduit system from the inert gas supply means to the gas mixture component supply conduit.

3. Apparatus as set forth in claim 1 wherein said alternative connection means is operable to connect the conduit system for the oxygen-bearing gas to the inert gas supply means.

4. Apparatus as set forth in claim 1 wherein said at least one conduit system can be connected to respective supply conduits for inert gas, with said connecting being triggered by means for sensing the temperature of the electrical heating resistance means, said inert gas being supplied until the ignition gas mixture reaches its ignition temperature.

5. Apparatus as set forth in claim 1 wherein the ignition gas mixture is composed of the same components as the main gas mixture.

6. Apparatus as set forth in claim 1 wherein the conduit systems for all the ignition gas mixture components are formed as electrical heating resistance means.

7. Apparatus as set forth in claim 1 wherein said conduit systems are electrically connected in series so as to form a common electrical heating resistance system.

8. Apparatus as set forth in claim 1 wherein each conduit system forms a separate electrical heating resistance system.

9. Apparatus as set forth in claim 1 wherein the conduit systems are arranged in a housing adapted to be mounted on a wall of a combustion chamber for the main gas mixture.

10. Apparatus as set forth in claim 9 wherein the housing includes a main portion which accommodates the part of said at least one conduit system which is formed as the electrical heating resistance means, and a portion of smaller section which communicates said main portion to said combustion chamber.

11. Apparatus as set forth in claim 10 wherein outlets of the conduit systems, at which the ignition gas components issue, are at an end of said smaller-section portion which is towards the combustion chamber.

12. Apparatus for igniting a gas mixture comprising:

a first conduit system for feeding an oxygen-bearing gas component of a combustible ignition gas mixture to an ignition region;

a second conduit system for feeding a combustible gas component of the ignition gas mixture to the ignition region, separately from the oxygen-bearing gas component, at least part of at least one of the conduit system providing electrical heating resistance means for heating the component flowing therein to a temperature adapted to cause ignition of the ignition gas mixture upon mixing thereof in the ignition region;

means for detecting the temperature of the ignition gas mixture, said means disposed in or adjacent to the region in which ignition of the ignition gas mixture occurs;

means for alternatively connecting at least one of the conduit systems to a supply means for supplying inert gas; and means for switching over of said at least one conduit system in response to the temperature detecting means, from the inert gas supply means to the gas mixture component supply conduit when a temperature is reached at which ignition of the ignition gas mixture can occur.

13. Apparatus as set forth in claim 12 wherein said temperature detecting means triggers a signal for said switching over of said at least one conduit system from the inert gas supply means to the gas mixture component supply conduit.

14. Apparatus as set forth in claim 12 wherein said temperature detecting means includes a temperature sensing element arranged in the ignition region.

15. Apparatus as set forth in claim 12 wherein said temperature detecting means includes a temperature sensing element arranged adjacent to the ignition region.

16. Apparatus as set forth in claim 12 wherein said alternative connection means is operable to connect the conduit system for the oxygen-bearing gas to the inert gas supply means.

17. Apparatus as set forth in claim 12 wherein said at least one conduit system can be connected to respective supply conduits for inert gas, with said connecting being triggered by means for sensing the temperature of the electrical heating resistance means, said inert gas being supplied until the ignition gas mixture reaches its ignition temperature.

18. Apparatus as set forth in claim 12 wherein the ignition gas mixture is composed of the same components as the main gas mixture.

19. Apparatus as set forth in claim 12 wherein the conduit systems for all the ignition gas mixture components are formed as electrical heating resistance means.

20. Apparatus as set forth in claim 12 wherein said conduit systems are electrically connected in series so as to form a common electrical heating resistance system.

21. Apparatus as set forth in claim 12 wherein each conduit system forms a separate electrical heating resistance system.

22. Apparatus as set forth in claim 12 wherein the conduit systems are arranged in a housing adapted to be mounted on a wall of a combustion chamber for the main gas mixture.

23. Apparatus as set forth in claim 22 wherein the housing includes a main portion which accommodates the part of said at least one conduit system which is formed as the electrical heating resistance means, and a portion of smaller section which communicates said main portion to said combustion chamber.

24. Apparatus as set forth in claim 23 wherein outlets of the conduit systems, at which the ignition gas components issue, are at an end of said smaller-section portion which is towards the combustion chamber.

* * * * *